US007909095B2

(12) United States Patent
Richards et al.

(10) Patent No.: US 7,909,095 B2
(45) Date of Patent: Mar. 22, 2011

(54) VALVE DEVICE AND ASSOCIATED METHODS OF SELECTIVELY COMMUNICATING BETWEEN AN INTERIOR AND AN EXTERIOR OF A TUBULAR STRING

(75) Inventors: William M. Richards, Frisco, TX (US); William D. Henderson, Tioga, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 172 days.

(21) Appl. No.: 12/247,115

(22) Filed: Oct. 7, 2008

(65) Prior Publication Data

US 2010/0084130 A1 Apr. 8, 2010

(51) Int. Cl.
*E21B 47/10* (2006.01)
*E21B 34/06* (2006.01)
*E21B 33/122* (2006.01)

(52) U.S. Cl. ..... 166/250.08; 166/142; 166/147; 166/149; 166/191; 166/323; 166/334.4

(58) Field of Classification Search ..... 166/250.08, 166/147, 142, 149, 191, 334.4
See application file for complete search history.

(56) References Cited

U.S. PATENT DOCUMENTS

| | | | | |
|---|---|---|---|---|
| 3,378,068 | A | | 4/1968 | Page, Jr. |
| 3,664,415 | A | | 5/1972 | Wray et al. |
| 3,750,752 | A | | 8/1973 | Mott |
| 3,850,250 | A | | 11/1974 | Holden et al. |
| 4,230,180 | A | | 10/1980 | Patton et al. |
| 4,399,870 | A | | 8/1983 | Baugh et al. |
| 4,403,659 | A | | 9/1983 | Upchurch |
| 4,429,747 | A | | 2/1984 | Williamson |
| 4,434,854 | A | | 3/1984 | Vann et al. |
| 4,452,310 | A | | 6/1984 | Pringle et al. |
| 4,513,764 | A | | 4/1985 | Yonker |
| 4,646,845 | A | | 3/1987 | Boeker |
| 4,657,082 | A | | 4/1987 | Ringgenberg |
| 4,657,083 | A | | 4/1987 | Ringgenberg |
| 4,718,496 | A | * | 1/1988 | Tompkins et al. ..... 166/387 |
| 4,979,569 | A | | 12/1990 | Anyan et al. |

(Continued)

FOREIGN PATENT DOCUMENTS

WO 9736089 A1 10/1997

OTHER PUBLICATIONS

Office Action issued May 5, 2009, for U.S. Appl. No. 11/871,040, 24 pages.

(Continued)

*Primary Examiner* — Giovanna C Wright
(74) *Attorney, Agent, or Firm* — Marlin R. Smith

(57) ABSTRACT

A valve device and associated methods of selectively communicating between an interior and an exterior of a tubular string. A valve device includes an openable and closable flowpath for selectively permitting and preventing flow between an interior and exterior of the valve device, and a lock assembly which prevents the flowpath from being opened greater than a predetermined number of times. A method of testing at least one annular seal in an annulus formed between a tubular string and a wellbore wall includes the steps of: sealingly engaging the annular seal to thereby prevent flow through the annulus across the annular seal; and applying a pressure differential across the annular seal to thereby test the annular seal, the pressure differential being applied via a valve device interconnected in the tubular string.

18 Claims, 14 Drawing Sheets

U.S. PATENT DOCUMENTS

| | | | | |
|---|---|---|---|---|
| 5,499,687 | A | 3/1996 | Lee | |
| 5,609,178 | A | 3/1997 | Hennig | |
| 5,819,853 | A | 10/1998 | Patel | |
| 6,102,126 | A | 8/2000 | Huber | |
| 6,230,807 | B1 | 5/2001 | Patel | |
| 6,352,119 | B1 | 3/2002 | Patel | |
| 6,386,289 | B1 | 5/2002 | Patel | |
| 6,397,949 | B1 | 6/2002 | Walker | |
| 6,422,317 | B1 | 7/2002 | Williamson, Jr. | |
| 6,550,541 | B2 | 4/2003 | Patel | |
| 6,945,331 | B2 | 9/2005 | Patel | |
| 7,063,152 | B2 | 6/2006 | Yeo | |
| 7,069,992 | B2 | 7/2006 | Lewis | |
| 7,152,678 | B2 | 12/2006 | Turner et al. | |
| 7,373,980 | B2 | 5/2008 | Lewis | |
| 2001/0042626 | A1 | 11/2001 | Patel | |
| 2002/0079103 | A1 | 6/2002 | Knowles | |
| 2002/0112862 | A1 | 8/2002 | Patel | |
| 2002/0157837 | A1* | 10/2002 | Bode et al. | 166/373 |
| 2004/0020657 | A1 | 2/2004 | Patel | |
| 2005/0072575 | A1 | 4/2005 | Yeo et al. | |

OTHER PUBLICATIONS

Office Action issued Jun. 18, 2010, for U.S. Appl. No. 11/871,040, 18 pages.

Office Action issued Jun. 23, 2009, for U.S. Appl. No. 12/203,011, 39 pages.

Halliburton product brochure, "Tubing-Installed Flow Control Equipment," pp. 2-15 to 2-17.

Halliburton drawing No. 531CV27509, "Circulating Control Valve Assembly," dated Jun. 28, 1997.

Halliburton, H03877, Well Completions product offering: "FracDoor Sliding Side-Door Circulation and Production Sleeve", dated Feb. 2006.

BJ Services Company product brochure, TIP-PT Packer, dated Mar. 12, 2003.

Office Action issued Nov. 16, 2009, for U.S. Appl. No. 11/871,040, 12 pages.

International Search Report and Written Opinion issued Nov. 25, 2009, for International Application Serial No. PCT/US09/059480, 8 pages.

* cited by examiner

VALVE DEVICE AND ASSOCIATED METHODS OF SELECTIVELY COMMUNICATING BETWEEN AN INTERIOR AND AN EXTERIOR OF A TUBULAR STRING

BACKGROUND

The present disclosure relates generally to equipment utilized and operations performed in conjunction with a subterranean well and, in an embodiment described herein, more particularly provides a valve device and associated methods of selectively communicating between an interior and an exterior of a tubular string.

In certain well operations, it is desirable to provide for selective fluid communication between the interior and exterior of a tubular string. For example, in a single trip multizone gravel packing operation, several packers in a tubular string may be set in a wellbore. Selective communication between the interior and exterior of the tubular string is desirable in this operation to provide for testing of the packers prior to gravel packing.

In the past, this packer testing function has been accomplished by opening ports in the packers themselves or in the tubular string between the packers. Unfortunately, these techniques have also involved either opening ports which cannot be re-closed, or manipulating another service string within the tubular string.

It will be appreciated that a permanently open port in the tubular string is highly detrimental if its associated packer is leaking (e.g., requiring that the tubular string be retrieved from the well), and that intervening into the tubular string with another service string (or wireline, etc.) is time-consuming and hazardous.

Therefore, it may be seen that improvements are needed in the art of providing selective communication between the interior and exterior of a tubular string. Such improvements would be useful in packer testing as discussed above, and also in other operations such as circulating, cementing, acidizing, fracturing, producing, injecting, conformance, etc.

SUMMARY

In the present specification, a valve device and associated methods are provided which solve at least one problem in the art. One example is described below in which the valve device provides for selective fluid communication between the interior and exterior of a tubular string. Another example is described below in which such fluid communication results only if an associated annular seal leaks, in which case the valve device can be re-closed without intervening into the tubular string.

In one aspect, a valve device is provided which includes an openable and closable flowpath for selectively permitting and preventing flow between an interior and an exterior of the valve device. A lock assembly prevents the flowpath from being cycled from closed to open greater than a predetermined number of times.

In another aspect, a method of testing at least one annular seal in an annulus formed between a tubular string and a wellbore wall is provided which includes the steps of: sealingly engaging the annular seal to thereby prevent flow through the annulus across the annular seal; and applying a pressure differential across the annular seal to thereby test the annular seal, the pressure differential being applied via a valve device interconnected in the tubular string. The pressure differential applying step may include transmitting pressure between an interior flow passage of the tubular string and the annulus via the valve device without permitting fluid communication between the annulus and the flow passage. The method may include the step of, after the pressure differential applying step, closing the valve device interconnected in the tubular string, thereby preventing fluid communication through the valve device between the annulus and an interior flow passage of the tubular string. The closing step may be performed without manipulating the tubular string and without intervening into the tubular string.

In yet another aspect, a test system for a well having an annulus formed between a tubular string and a wall of a wellbore includes multiple sets of annular seals for sealing the annulus at longitudinally spaced apart locations, with each of the sets including at least two annular seals. Multiple valve devices are openable and closable in response to variation of pressure in an interior flow passage of the tubular string. Each of the valve devices thereby selectively permits and prevents fluid communication between the interior flow passage and the annulus longitudinally between the annular seals of a respective one of the sets of annular seals.

In a further aspect, an annular seal assembly is provided which includes at least two annular seals and a valve device with an openable and closable flowpath for selectively permitting and preventing flow between an interior of the seal assembly and an exterior of the seal assembly longitudinally between the annular seals. The valve device also includes a lock assembly which prevents the flowpath from being cycled from closed to open greater than a predetermined number of times, with the flowpath being cyclable from closed to open at least one time.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
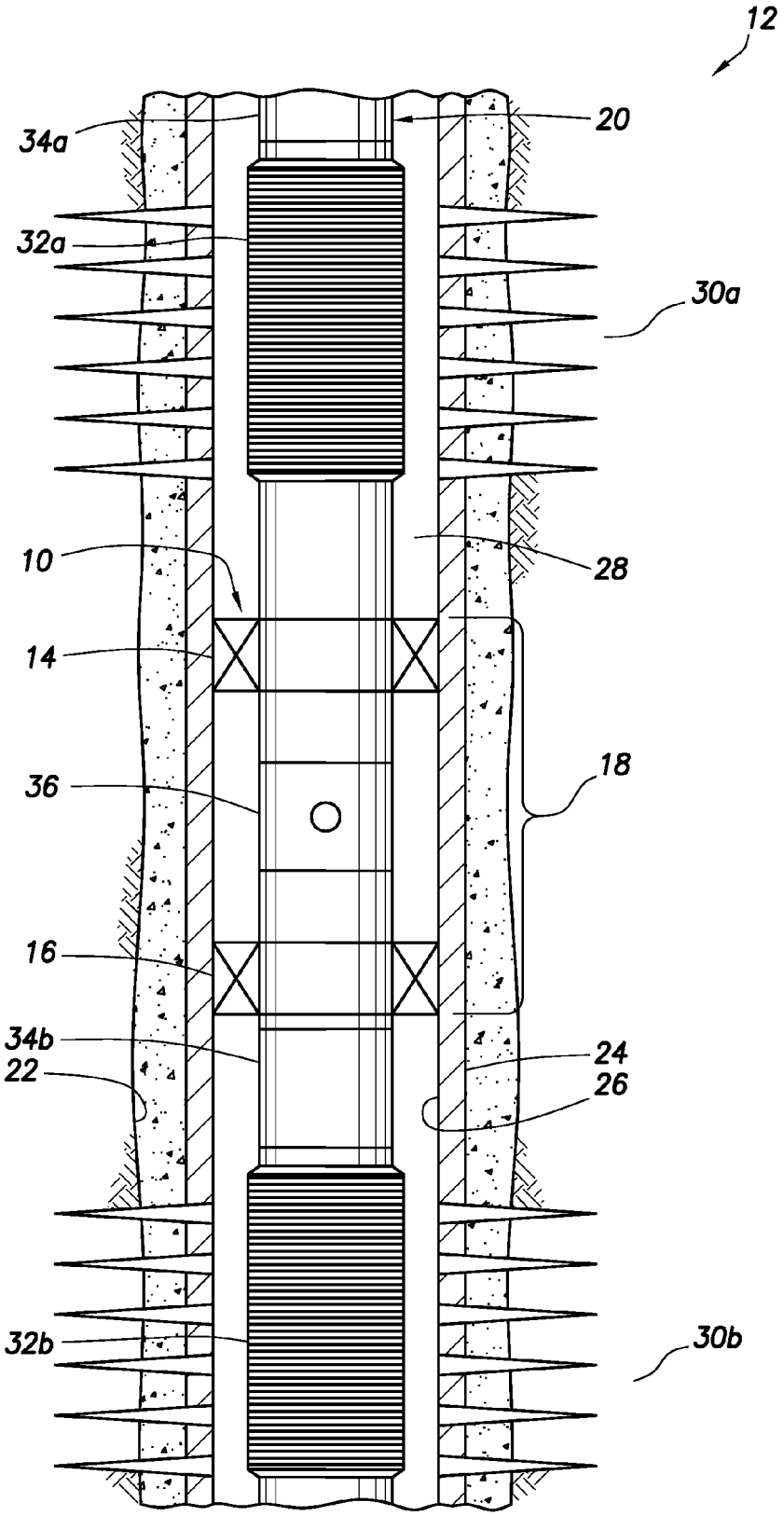
FIG. 1 is a schematic partially cross-sectional view of a test system and associated method embodying principles of the present disclosure.

Representatively illustrated in FIG. 1 is a test system 10 which embodies principles of the present disclosure. The test system 10 in this example is part of an overall well system 12 in which a multi-zone gravel packing operation is to be performed, and in which it is desired to pressure test multiple packers or annular seals 14, 16 prior to the gravel packing operation.

However, it should be clearly understood that the principles of this disclosure are not limited to use in testing annular seals for gravel packing operations, or in any particular testing operation. Instead, the principles described herein may be used in a wide variety of different techniques, operations and configurations.

As depicted in FIG. 1, the annular seals 14, 16 are part of an annular seal assembly 18 interconnected in a tubular string 20 positioned in a wellbore 22. In this example, the wellbore 22 is provided with protective casing 24 defining an inner wall 26 for the wellbore, but in other examples the wellbore could be uncased or open, in which case the inner wall would be defined by the wellbore itself.

The annular seal assembly 18 is used to prevent flow longitudinally through an annulus 28 formed radially between the tubular string 20 and the inner wall 26. In this manner, the seals 14, 16 provide for isolation in the wellbore 22 between two formation zones 30*a,b* intersected by the wellbore, thereby allowing the zones to be independently stimulated, gravel packed, produced, isolated, etc.

The tubular string 20 also includes various other equipment, such as screens 32*a* and 32*b*, gravel packing tools 34*a* and 34*b* (e.g., flow control devices, seals crossovers, etc.). Of course, any number, combination, configuration and/or arrangement of this or any other equipment may be used in keeping with the principles of this disclosure.

The annular seal assembly 18 also includes a valve device 36 which selectively permits and prevents fluid communication between the annulus 28 and an interior flow passage of the tubular string 20. In this manner, the sealing integrity of each of the annular seals 14, 16 may be tested after the seals have been engaged to seal the annulus 28 between the tubular string 20 and the inner wall 26.

For example, if the seals 14, 16 are set by pressure or mechanical force, then the valve device 36 may be opened after the seals 14, 16 are set. Pressure may then be applied to the annulus 28 longitudinally between the seals 14, 16 via the open valve device 36 from the interior flow passage of the tubular string 20 to test the sealing integrity of the seals. Note that, during this testing operation, fluid communication radially through the screens 32*a,b* is preferably not permitted (e.g., by closing sliding sleeve valves (not shown) or other flow control devices for the screens).

Several unique features of the valve device 36 allow the testing operation to be performed without intervening into the tubular string 20, without manipulation of the tubular string, and/or with the ability to re-close the valve device even if one or both of the seals 14, 16 should leak. These and other features of the valve device 36 are described below in detail for several configurations of the valve device. However, it should be clearly understood that the principles of this disclosure are not limited in any way to any particular features or combination of features described for the valve device configurations below.

Figure 2:
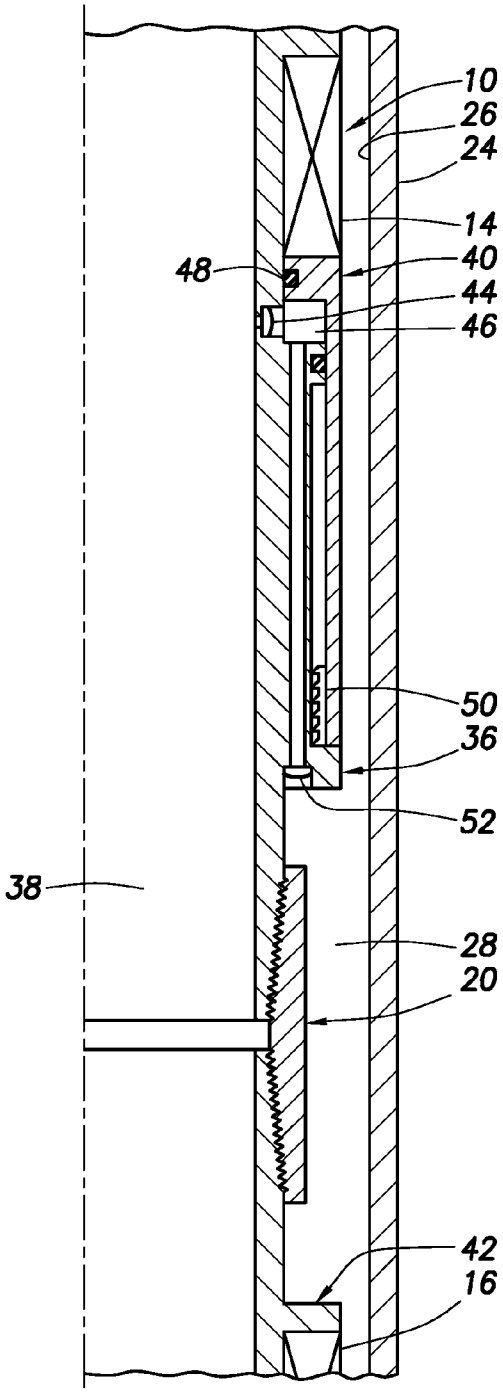
FIGS. 2 & 3 are enlarged scale schematic quarter-sectional views of an annular seal assembly usable in the test system.

Referring additionally now to FIG. 2, the test system 10 is representatively illustrated within the casing 24, but apart from the remainder of the well system 12, for illustrative clarity. Note that the interior flow passage 38 of the tubular string 20 extends longitudinally through the test system 10, including the annular seals 14, 16 and the valve device 36. The annulus 28 is exterior to the seals 14, 16 and the valve device 36.

In this configuration, the upper seal 14 is part of a hydraulically set packer 40, and the valve device 36 is incorporated with the packer, so that the packer and valve device are a single well tool for interconnection in the tubular string 20. In contrast, the lower seal 16 is part of another hydraulically set packer 42 which is preferably of conventional construction.

In other examples, the valve device 36 could be incorporated into a single well tool with the lower packer 42, the valve device could be incorporated into a single well tool with both of the upper and lower packers 40, 42, or each of these devices could be separate well tools. Thus, it will be appreciated that any combination or arrangement of the devices described herein may be used in keeping with the principles of this disclosure.

Since the lower packer 42 in the example of FIG. 2 is preferably of conventional construction, it will not be described further herein, except to note that it preferably includes slips for gripping the inner wall 26. The upper packer 40 in this example preferably does not include slips for gripping the inner wall 26, and so the lower packer 42 is preferably set first, followed by setting of the upper packer. This is accomplished by applying increased pressure to the flow passage 38 to set the lower packer 42, and then further increasing the pressure in the flow passage to set the upper packer 40.

At a predetermined level of pressure in the flow passage 38, a burst disk 44 in the upper packer 40 will rupture, thereby admitting the pressure into a chamber 46. Pressure in the chamber 46 greater than pressure in the annulus 28 will cause a piston 48 to displace upwardly and longitudinally compress the annular seal 14, thereby radially outwardly extending the seal into sealing engagement with the inner wall 26. A slip or ratchet mechanism 50 prevents the piston 48 from displacing downwardly if the pressure in the chamber 46 decreases.

Note that there are many different ways of sealingly engaging a seal, and that the hydraulically set packer 40 is just one example. Other ways include mechanically displacing the seal, swelling the seal, inflating the seal, etc. Thus, it will be appreciated that the principles of this disclosure are not limited to use with hydraulically set packers.

Figure 3:
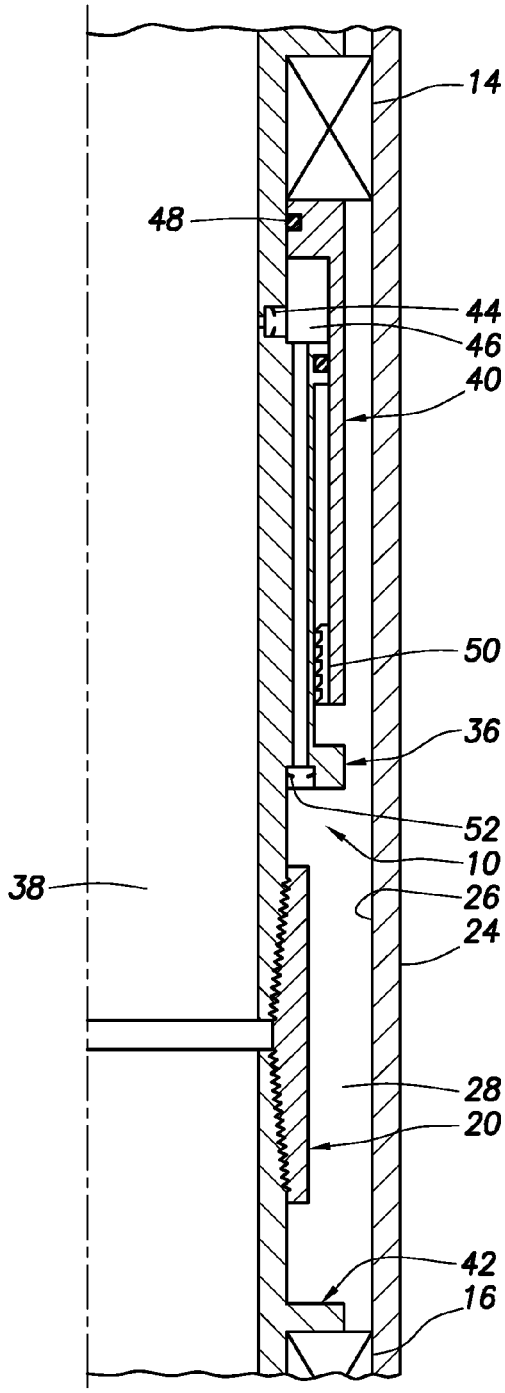

Referring additionally now to FIG. 3, the test system 10 is representatively illustrated after the upper packer 40 has been set. The upper seal 14 is now sealingly engaged between the tubular string 20 and the inner wall 26, with the lower seal 16 having previously been sealingly engaged between the tubular string and the inner wall, as described above. A section of the annulus 28 longitudinally between the seals 14, 16 is now isolated from the remainder of the annulus.

Pressure in the flow passage 38 has been further increased to another predetermined level to thereby rupture another bust disk 52 which initially isolated the chamber 46 from the annulus 28. After the disk 52 is ruptured, fluid communication is permitted between the flow passage 38 and the annulus 28.

The seals 14, 16 can now be pressure tested, for example, by applying pressure to the flow passage 38, which pressure will be communicated to the annulus 28 between the seals 14, 16. If either of the seals 14, 16 leaks, then fluid loss and/or pressure decrease will be detected in the flow passage 38.

Additional equipment (such as sensors, etc.) may be used if desired to determine which of the seals 14, 16 is leaking. If neither of the seals 14, 16 is leaking, then the gravel packing operations may proceed. If only one of the seals 14, 16 is leaking, then a decision may be made whether or not to proceed with the gravel packing operations, or whether to retrieve the tubular string 20 and replace any of the packers 40, 42 and/or seals 14, 16.

Referring additionally now to FIGS. 4-8, another configuration of the valve device 36 is representatively illustrated. In this configuration, the seals 14, 16 can be pressure tested without necessarily opening a flowpath to fluid communication between the flow passage 38 and the annulus 28. Instead, the flowpath opens only if one or both of the seals 14, 16 leaks. Once opened, the flowpath can be re-closed, in order to again isolate the annulus 28 from the flow passage 38 at the valve device 36.

Figure 4:
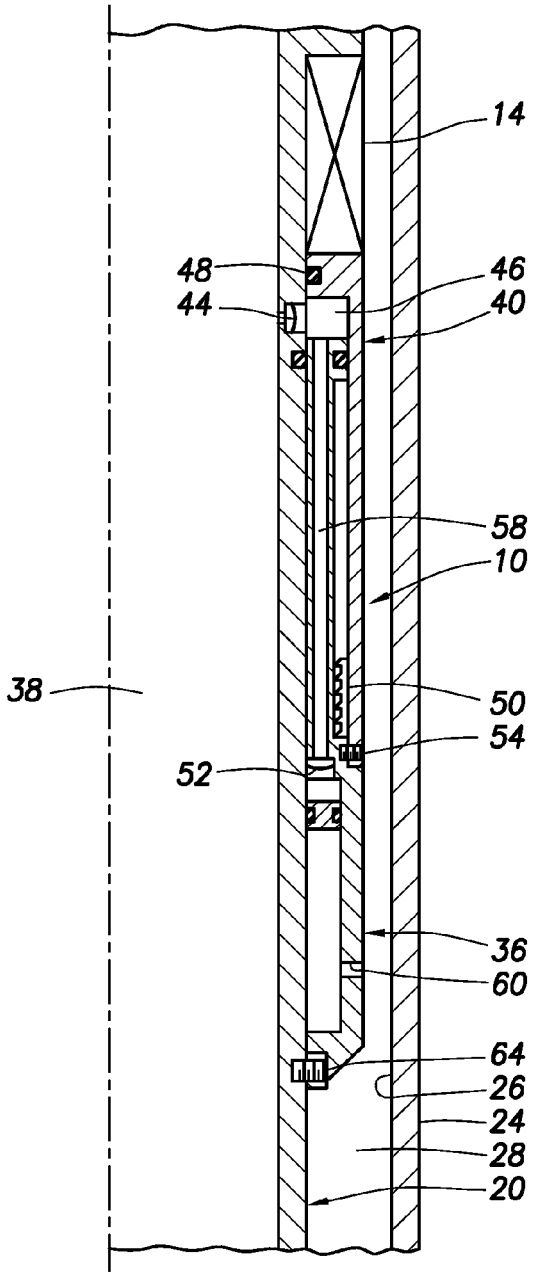
FIGS. 4-8 are schematic quarter-sectional views of another configuration of a valve device usable in the annular seal assembly.

In FIG. 4, the test system 10 is depicted prior to setting the upper packer 40. Note that the lower packer 42 is not illustrated in FIGS. 4-8, but its operation would preferably be the same as, or at least similar to, that described above for FIGS. 2 & 3.

Preferably, the lower packer 42 would be set (prior to setting the upper packer 40) by increasing pressure in the flow passage 38 to a predetermined level. Pressure in the flow passage 38 would then be increased further to another predetermined level to set the upper packer 40.

Figure 5:
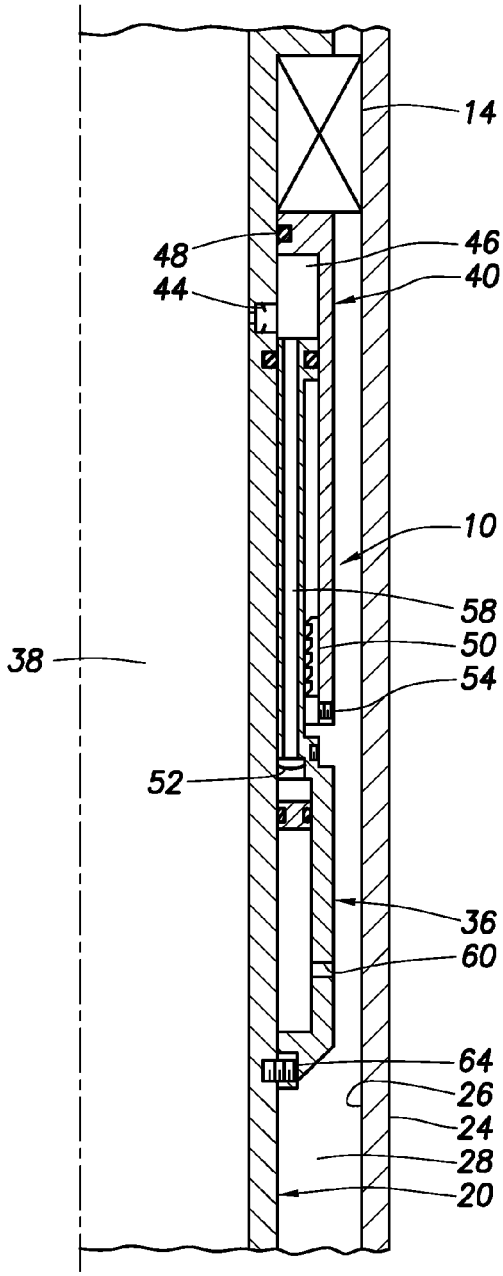

In FIG. 5, the system 10 is depicted after the upper packer 40 has been set. The burst disk 44 has been ruptured, and the piston 48 has displaced upward to compress and radially outwardly extend the seal 14 into sealing engagement with the inner wall 26.

Note that, instead of or in addition to the burst disk 44, one or more shear screws 54 may be used to restrain the piston 48 until the predetermined pressure differential from the flow passage 38 to the annulus 28 has been achieved. Thus, it will be appreciated that various different configurations of the packer 40 can be used in keeping with the principles of this disclosure.

Figure 6:
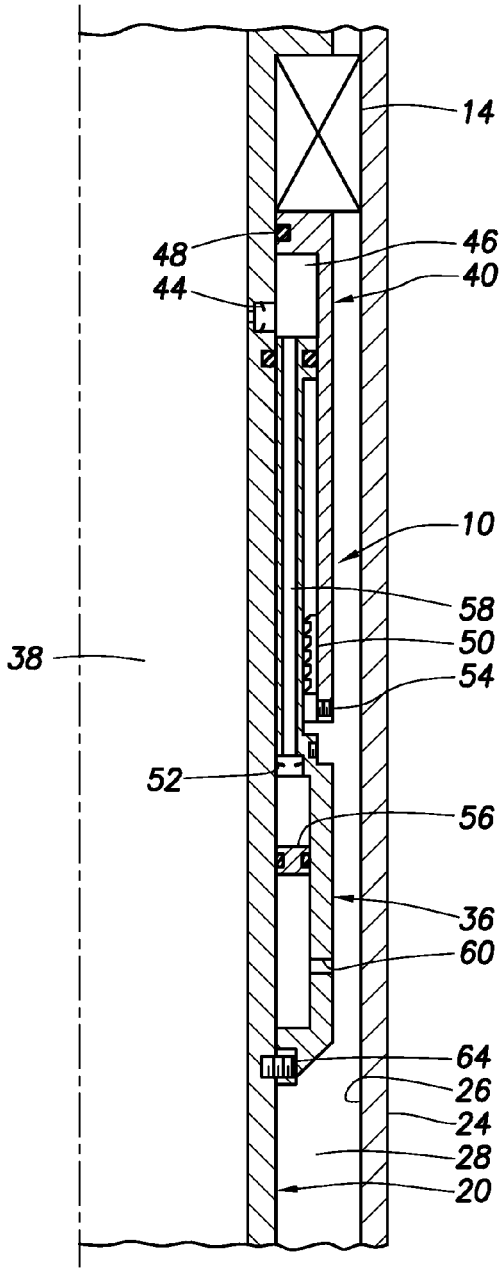

In FIG. 6, the system 10 is depicted after the pressure in the flow passage 38 has been further increased to rupture the burst disk 52. However, note that there is no fluid communication between the flow passage 38 and the annulus 28 at this point.

Instead, a floating piston 56 continues to provide fluid isolation between the flow passage 38 and the annulus 28. As pressure in the flow passage 38 is increased or decreased, the piston 56 may displace respectively downwardly or upwardly (depending on the pressure differential between the flow passage and the annulus 28 at any given time), but unless at least one of the seals 14, 16 leaks, there will be no fluid communication between the flow passage and the annulus.

As depicted in FIG. 6, the piston 56 has displaced downward somewhat (as compared to its position as viewed in FIG. 5) due to the pressure differential from the flow passage 38 to the annulus 28. Once pressures in the flow passage 38 and annulus 28 between the seals 14, 16 are equalized, the piston 56 will stop displacing, and this will indicate that neither of the seals 14, 16 is leaking. Thus, a successful pressure test will be accomplished without the need to open a flowpath which permits fluid communication between the interior and exterior of the tubular string 20. The flowpath 58 is opened by rupturing the disks 44 and 52, but as long as neither of the seals 14, 16 is leaking, there will be no fluid communication between the passage 38 and annulus 28 via the flowpath 58.

Figure 7:
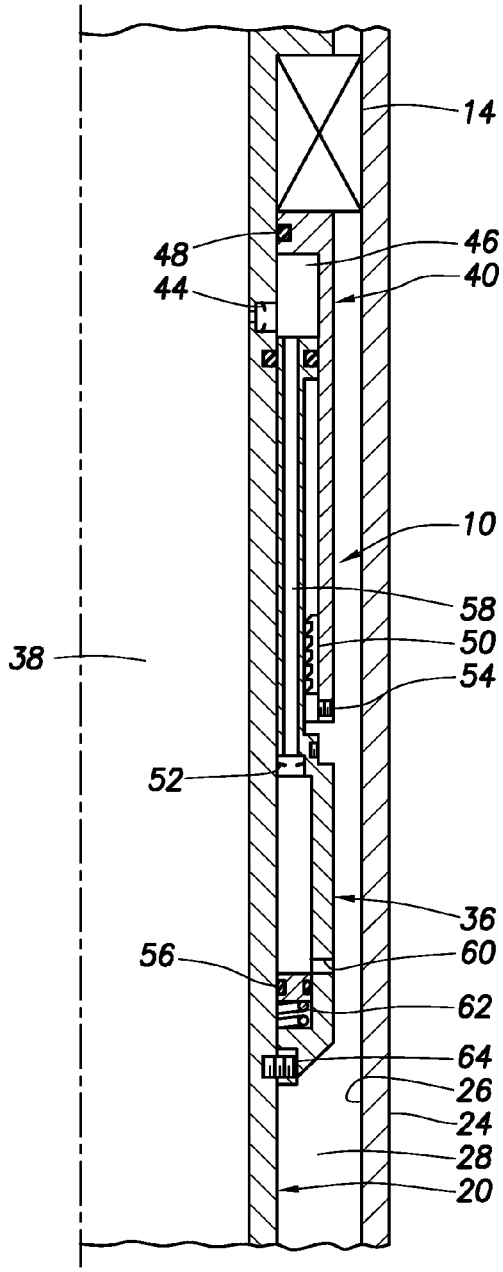

In FIG. 7, the system 10 is depicted in the case where one or both of the seals 14, 16 is leaking. The pressure differential from the flow passage 38 to the annulus 28 does not equalize in this case, and the piston 56 displaces downwardly past an opening 60.

Thus, the flowpath 58 is opened to allow fluid communication between the flow passage 38 and the annulus 28. The flowpath 58 in this example extends from the passage 38, through the burst disk 44, through the burst disk 52, through the opening 60 and to the annulus 28. A decrease in pressure and/or loss of fluid in the passage 38 will indicate that one or both of the seals 14, 16 is leaking.

If the pressure differential from the passage 38 to the annulus 28 is subsequently relieved, a biasing device 62 (such as a compression spring, compressed gas chamber, etc.) may be used to upwardly displace the piston 56 past the opening 60. Thus, the flowpath 58 can be re-closed (to thereby again prevent fluid communication between the passage 38 and the annulus 28) after having been opened.

Figure 8:
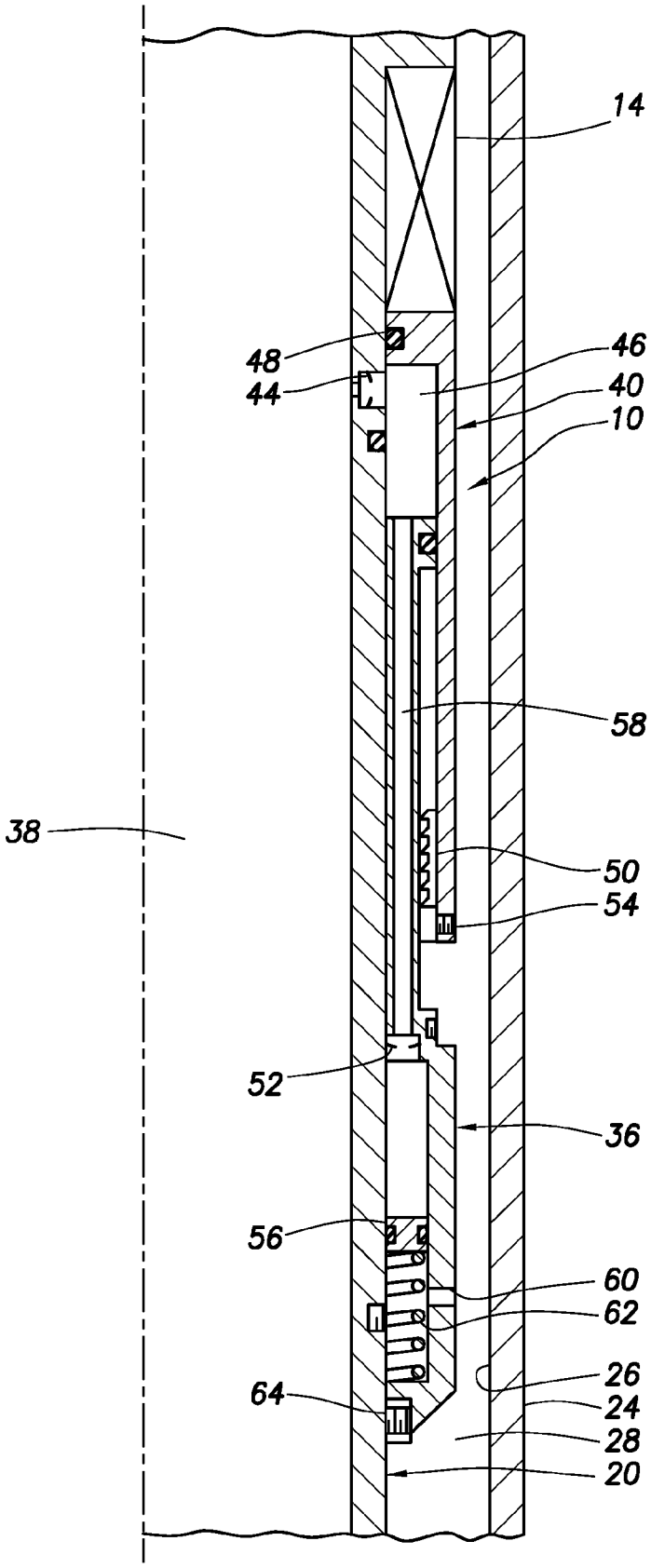

In FIG. 8, the system 10 is depicted after the pressure differential from the passage 38 to the annulus 28 has been relieved. The biasing device 62 has upwardly displaced the piston 56 past the opening 60, so that fluid communication is again prevented between the passage 38 and the annulus 28 via the flowpath 58.

In addition, the packer 40 has been unset in preparation for retrieving the tubular string 20 from the well. To unset the packer 40, an upwardly directed force is applied to the tubular string 20 to shear one or more shear screws 64. This allows the piston 48 to displace downwardly and uncompress the seal 14, thereby disengaging the seal from the inner wall 26.

Figure 9:
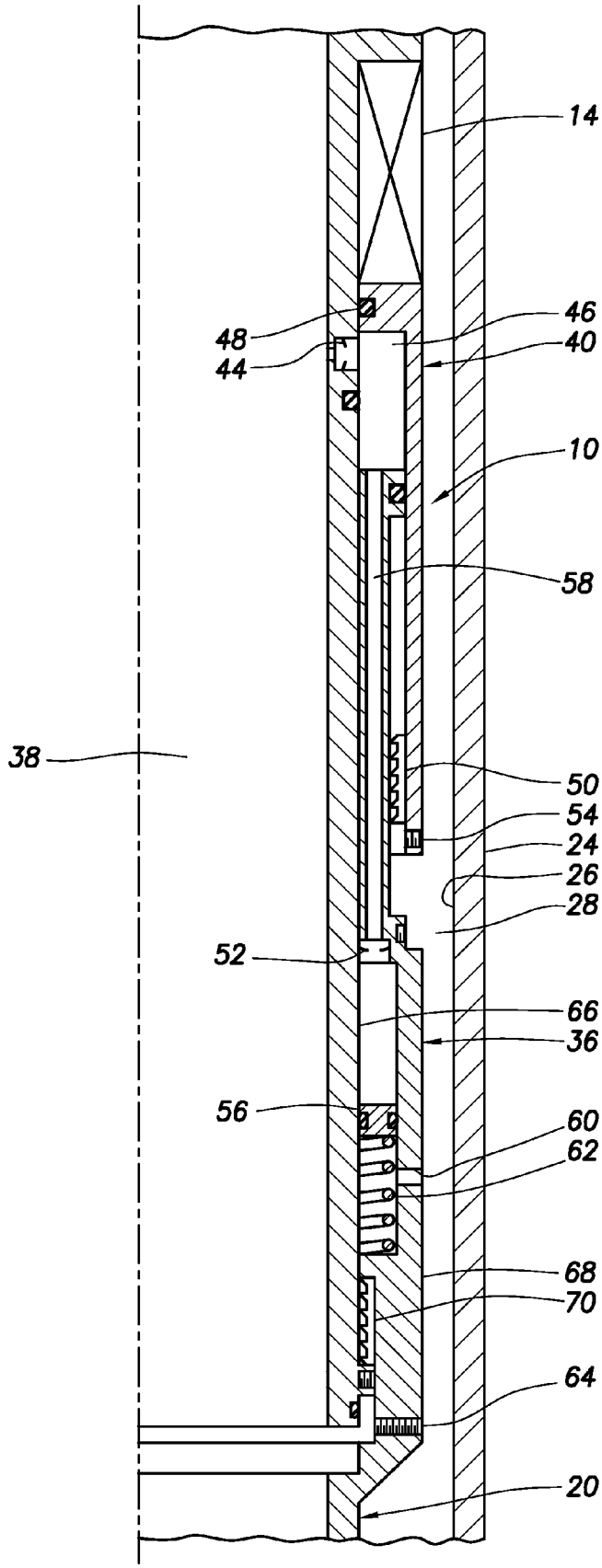
FIG. 9 is a schematic quarter-sectional view of another configuration of the valve device.

Referring additionally now to FIG. 9, another configuration of the packer 40 and valve device 36 is representatively illustrated. In this view, the packer 40 and valve device 36 are configured similar to that depicted in FIG. 10 (e.g., after the disks 44, 52 have been ruptured, the flowpath 58 is closed, and the tubular string 20 is to be retrieved from the well).

However, the mechanism for unsetting the packer 40 is somewhat different in the configuration of FIG. 9, in that shearing of the shear screws 64 allows an inner mandrel 66 to displace upwardly relative to an outer housing 68 which is rigidly connected to the tubular string 20 below the packer 40 and valve device 36, thereby uncompressing the seal 14. A slip or ratchet mechanism 70 prevents subsequent downward displacement of the inner mandrel 66 relative to the outer housing 68.

Figure 10:
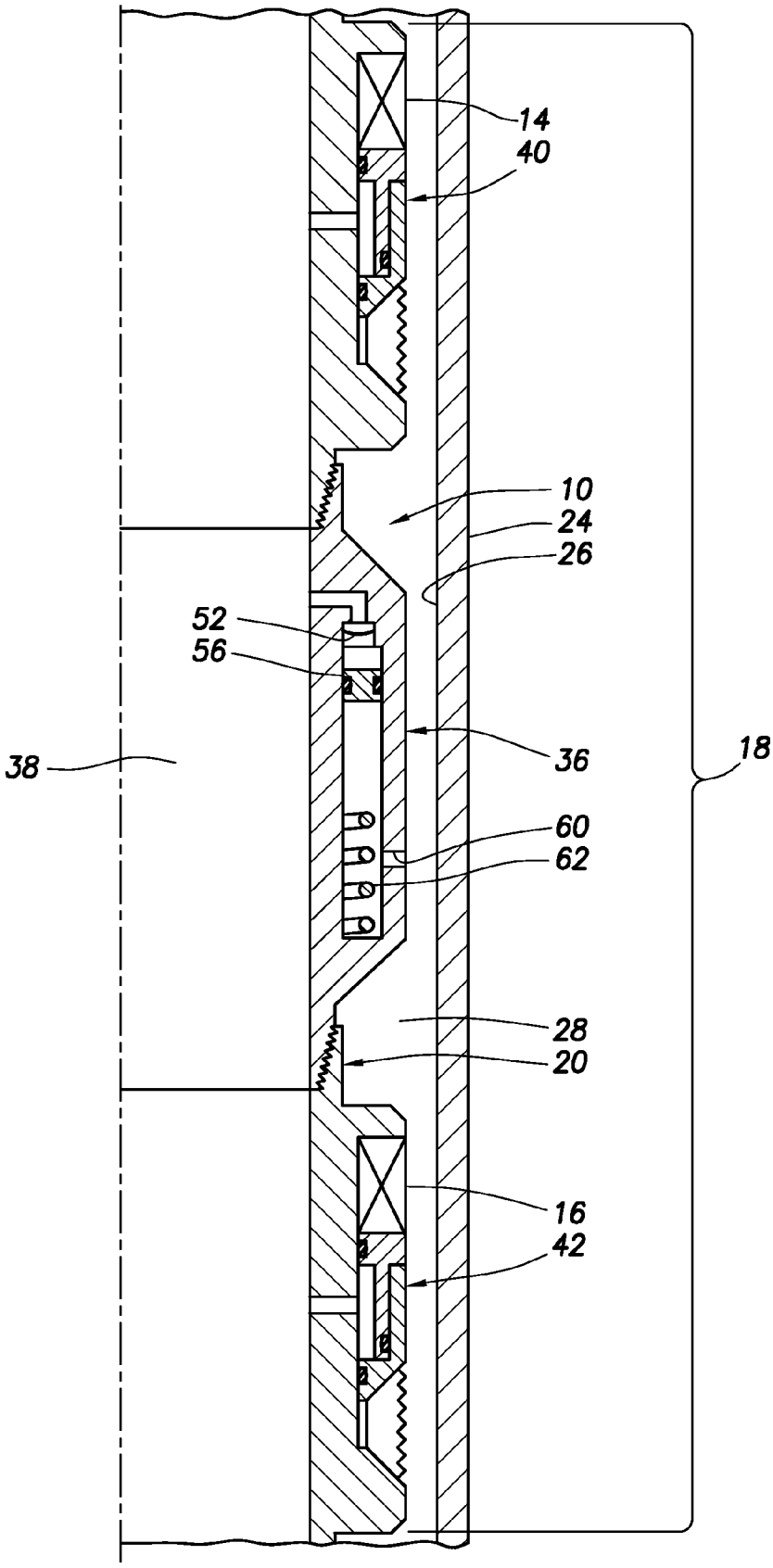
FIG. 10 is a schematic quarter-sectional view of another configuration of the annular seal assembly.

Referring additionally now to FIG. 10, another configuration of the annular seal assembly 18 is representatively illustrated. In this configuration, both of the upper and lower packers 40, 42 are conventional hydraulically set packers, and the valve device 36 is interconnected between the packers.

Operation of the valve device 36 is similar to that described above for the configuration of FIGS. 4-8, except that the burst disk 52 is exposed to the pressure differential between the passage 38 and the annulus 28 without the need to first rupture the burst disk 44. However, in the configuration of FIG. 10 it is still preferred that the burst disk 52 not rupture until both of the packers 40, 42 have been set.

Referring additionally now to FIGS. 11-15, another configuration of the valve device 36 is representatively illustrated. This configuration is similar to that described above for the configuration of FIG. 10 (in that the valve device 36 is a separate component and the burst disk 52 is exposed to the pressure differential between the passage 38 and the annulus 28 without first rupturing the burst disk 44) and its operation is similar to that described above for the configuration of FIGS. 4-8.

However, instead of displacing past the opening 60 to open the flowpath 58 in the event that either of the seals 14, 16 leaks, the piston 56 displaces out of a bore 72, and the valve device 36 of FIGS. 11-15 includes a lock assembly 74 to lock the valve closed after it has been opened a predetermined number of times.

Figure 11:
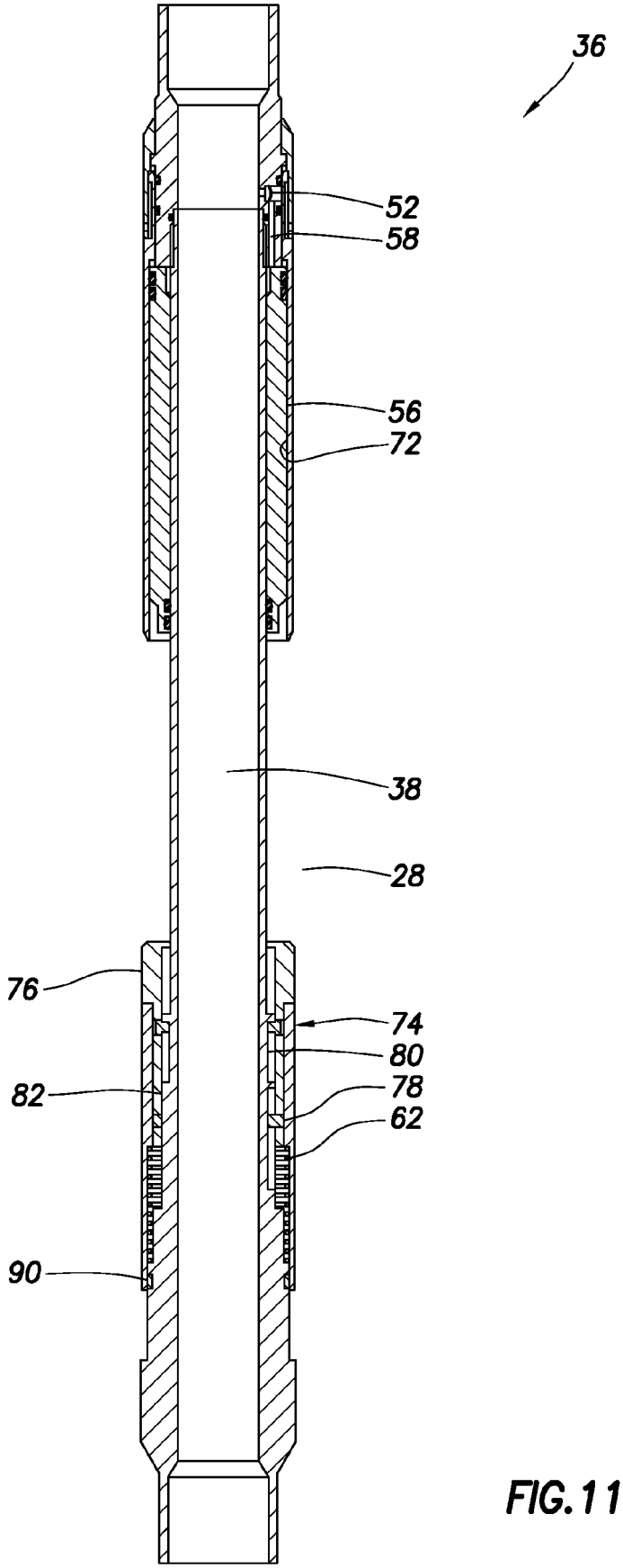
FIGS. 11-15 are schematic cross-sectional views of another configuration of the valve device.

In FIG. 11, the valve device 36 is depicted prior to the burst disk 52 being ruptured. The piston 56 is received in the bore 72. Thus, the flowpath 58 between the burst disk 52 and the piston 56 is isolated from both the passage 38 and the annulus 28.

Figure 12:
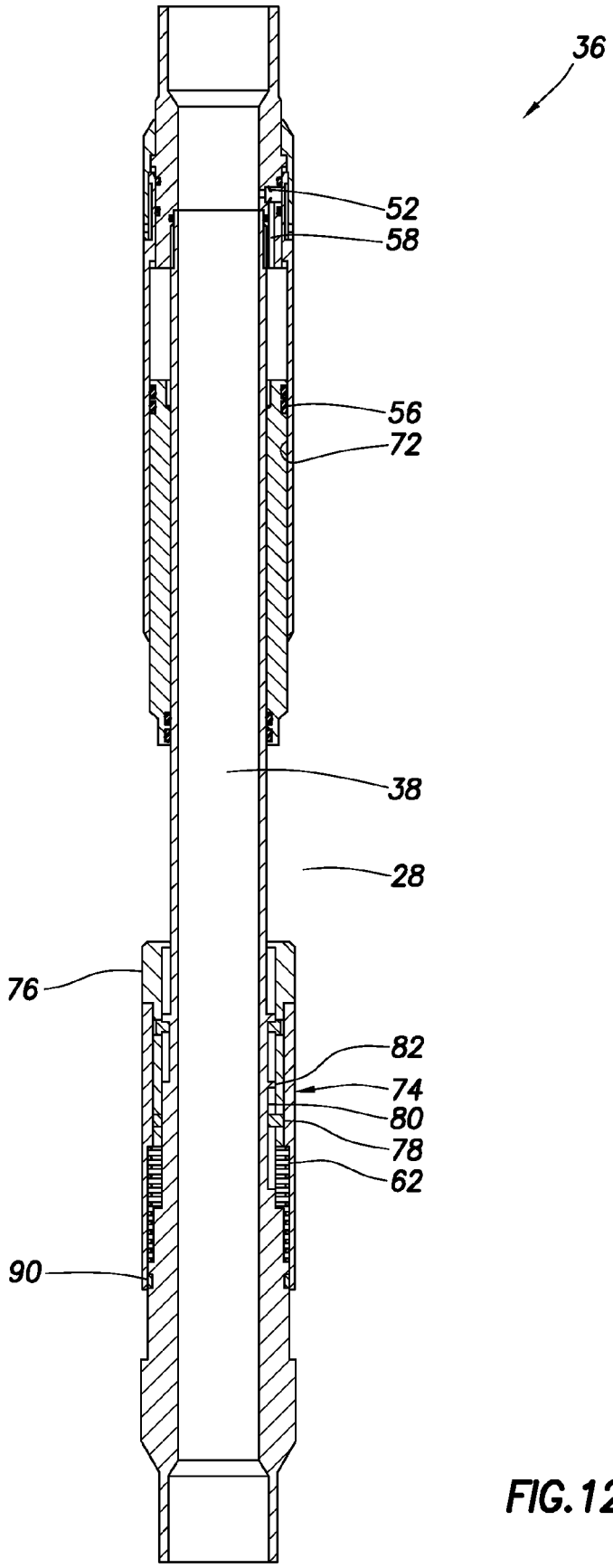

In FIG. 12, the burst disk 52 has been ruptured by increasing pressure in the passage 38 to a predetermined level. The piston 56 has displaced downwardly somewhat, as would be the case if neither of the seals 14, 16 is leaking. As in the other configurations described above, the piston 56 displaces downward until pressures in the passage 38 and annulus 28 are balanced, if neither of the seals 14, 16 is leaking.

Figure 13:
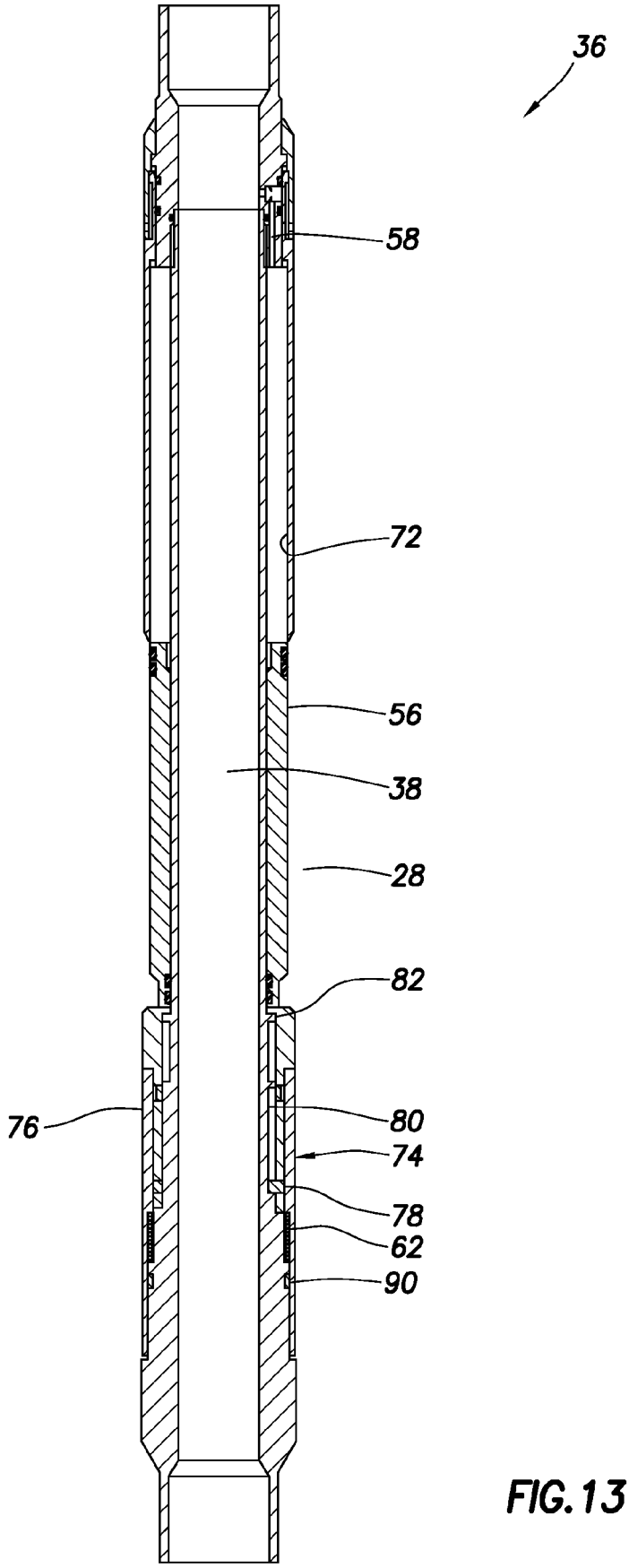

In FIG. 13, the valve device 36 is depicted in the event that one or both of the seals 14, 16 does leak. The piston 56 has displaced out of the bore 72, and fluid communication is now permitted between the passage 38 and the annulus 28 via the flowpath 58.

Note that the piston 56 has also contacted and downwardly displaced an outer housing 76 of the lock assembly 74, and has thereby compressed the biasing device 62. A lug 78 projects inwardly from the housing 76 into engagement with a profile 80 formed externally on an inner mandrel 82 of the lock assembly 74.

The profile 80 may be of the type known to those skilled in the art as a "J-slot" profile. When the housing 76 and lug 78 displace longitudinally relative to the mandrel 82 and profile 80, the engagement between the lug and profile causes relative rotation between the housing and the mandrel, and the lug enters different portions of the profile.

Figure 14:
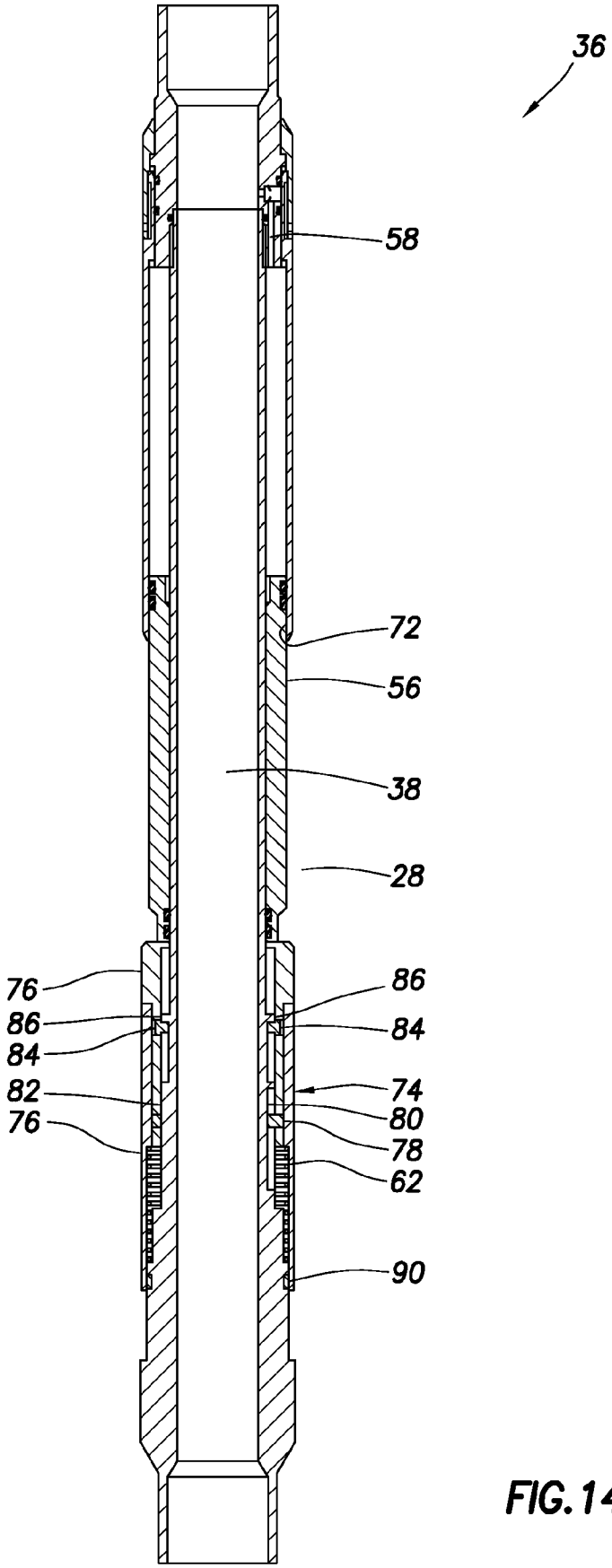

In FIG. 14, the pressure differential from the passage 38 to the annulus 28 has been relieved, and the biasing device 62 has upwardly displaced the piston 56 so that it is again received in the bore 72. This closes the flowpath 58 and prevents fluid communication between the passage 38 and the annulus 28.

Note that inwardly projecting pins 84 carried on the outer housing 76 engage a shoulder 86 on the inner mandrel 82 to limit the upward displacement of the outer housing. However, the shoulder 86 has slots 88 formed in it which allow the pins 84 to displace upwardly past the shoulder to thereby allow the outer housing 76 to displace further upwardly relative to the inner mandrel 82 when the pins are aligned with the slots.

This alignment between the pins 84 and the slots is controlled by the engagement between the lug 78 and the profile 80. That is, as the lug 78 displaces to successive different portions of the profile 80, the outer housing 76 rotates about the inner mandrel 82, until eventually the pins 84 are aligned with the slots. At that point, the outer housing 76 can displace upwardly a greater distance.

Figure 15:
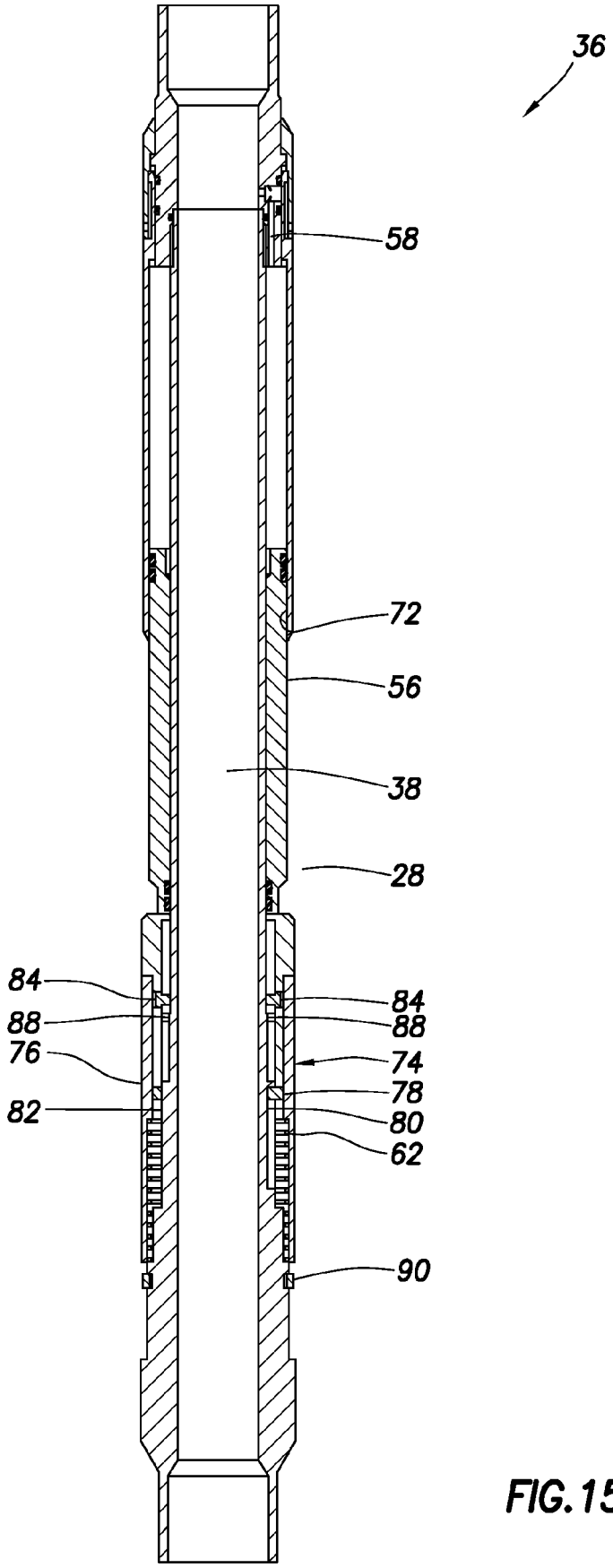

In FIG. 15, the outer housing 76 has been displaced upwardly and downwardly relative to the inner mandrel 82 a sufficient number of times that the pins 84 have been aligned with the slots 88 and, upon relieving the pressure differential from the passage 38 to the annulus 28, the biasing device 62 displaces the outer housing and piston 56 upward. The outer housing 76 is displaced further upward relative to the inner mandrel 82 than previously, due to the alignment of the pins 84 with the slots 88.

This further upward displacement of the outer housing 76 allows a snap ring 90 to extend outward and prevent subsequent downward displacement of the outer housing sufficient to permit the piston 56 to displace out of the bore 72. Thus, the flowpath 58 is closed and fluid communication cannot again be permitted between the passage 38 and the annulus 28 through the flowpath.

It will be readily appreciated that the lock assembly 74 can be configured to permit the flowpath 58 to be opened and closed any number of times before the lock assembly prevents subsequent opening of the flowpath. For example, the profile 80 can be changed and/or the azimuthal relationship between the pins 84 and the slots 88 can be changed to thereby change the number of times the piston 56 displaces the outer housing 76 downward prior to the pins being aligned with the slots.

However, in the example of FIGS. 11-15, the outer housing 76 is not displaced downwardly by the piston 56 unless the flowpath 58 is opened at least one time due to at least one of the seals 14, 16 leaking. Thus, if one of the seals 14, 16 does not leak, then the flowpath 58 is not opened at all, and the lock assembly 74 is not operated at all.

Figure 16:
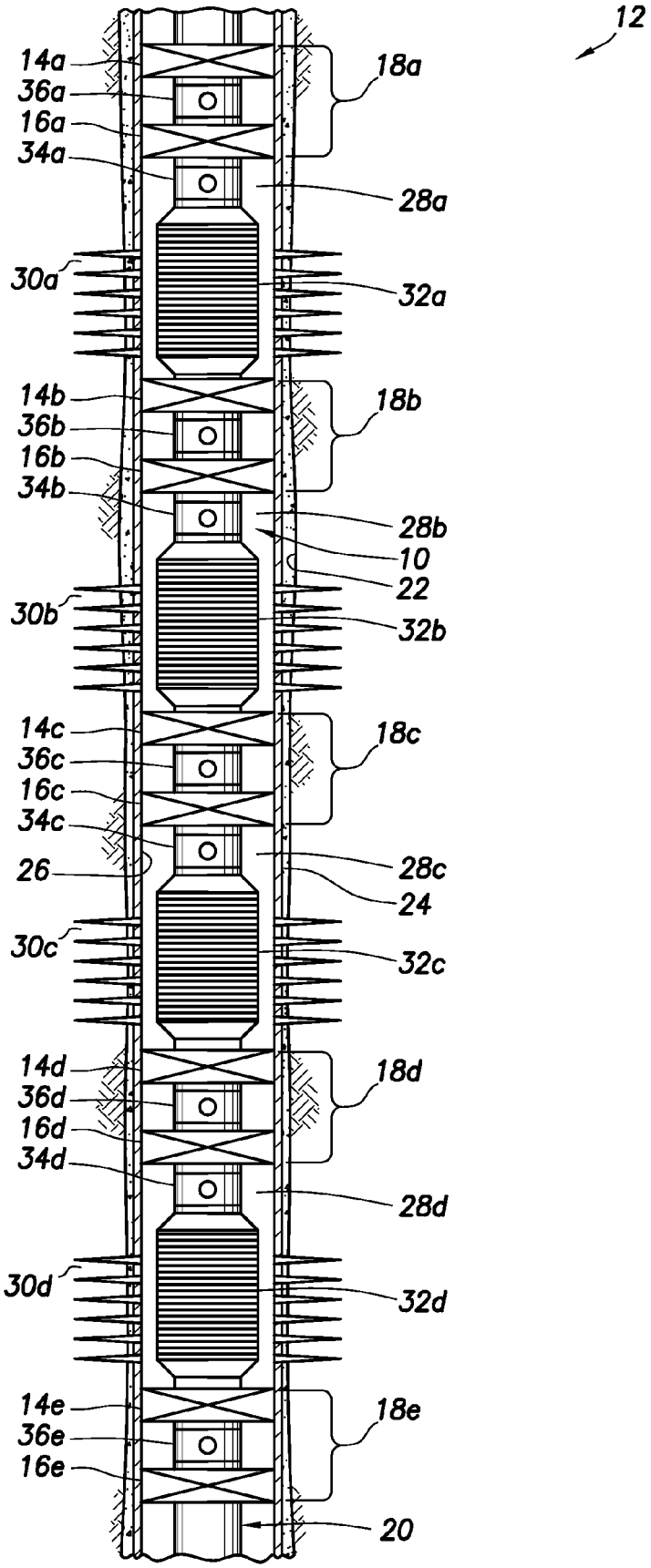
FIG. 16 is a schematic partially cross-sectional view of another test system and associated method embodying principles of the present disclosure.

Referring additionally now to FIG. 16, another configuration of the test system 10 is representatively illustrated in which multiple annular seal assemblies 18*a-e* are used to isolate multiple corresponding sections 28*a-d* of the annulus 28 in a multi-zone gravel packing operation. In this example, the seal assemblies 18*a-e* utilize the valve device 36 configuration of FIGS. 11-15 in order to permit determination of which of the seal assemblies 18*a-e* is leaking in a pressure test.

The annulus sections 28*a-d* correspond to formation zones 30*a-d*. Screens 32*a-d* and gravel packing tools 34*a-d* are interconnected in the tubular string 20 for gravel packing the zones 30*a-d*.

The annular seal assemblies 18*a-e* straddle the zones 30*a-d*, so that each of the zones can be independently stimulated, gravel packed, produced, isolated, etc. The seal assemblies 18*a-e* include respective annular seals 14*a-e*, annular seals 16*a-e* and valve devices 36*a-e*.

As noted above, the valve devices 36*a-e* are preferably of the configuration depicted in FIGS. 11-15 and described above. However, the lock assemblies 74 of the valve devices 36*a-e* are individually configured to permit the valve devices to be opened and closed a different number of times before being locked closed.

Preferably, each successive one of the valve devices 36*a-e* is configured to lock closed in response to a correspondingly increased number of pressure increases and then decreases in the flow passage 38 to open and close the flowpaths 58 of the valve devices. For example, valve device 36*a* is configured to lock closed upon being opened and then closed once, valve device 36*b* is configured to lock closed upon being opened and then closed twice, valve device 36*c* is configured to lock closed upon being opened and then closed three times, valve device 36*d* is configured to lock closed upon being opened and then closed four times, and valve device 36*e* is configured to lock closed upon being opened and then closed five times. However, as described above for the configuration of FIGS. 11-15, none of the valve devices 36*a-e* will open unless at least one of the seals 14*a-e* or 16*a-e* leaks during a pressure test.

In operation, the test system 10 of FIG. 16 would function as follows: The seals 14*a-e* and 16*a-e* would be sealingly engaged with the inner wall 26 to thereby seal off the annulus 28 into separate isolated sections 28*a-d*. Preferably, this would be accomplished by increasing pressure in the interior of the tubular string 20 to a predetermined level to set packers associated with the seals 14*a-e* and 16*a-e* as described above, although other means of sealingly engaging the seals may be used if desired.

Pressure in the interior of the tubular string 20 would then be further increased to another predetermined level at which the burst disks 52 of the valve devices 36*a-e* will rupture. If none of the seals 14*a-e* or 16*a-e* leaks, then no fluid communication between the interior and exterior of the tubular string 20 (i.e., between the passage 38 and the annulus 28 longitudinally between the respective seals) will be permitted, and this will be an indication that all of the seals have passed the pressure test. In that case, the gravel packing operation can proceed.

If, however, at least one of the seals 14*a-e* or 16*a-e* does leak, then a loss of pressure and/or fluid in the interior of the tubular string 20 will indicate this. It is a unique feature of the system 10 that at this point it may be determined which of the seals 14*a-e* or 16*a-e* is leaking.

It is known at this point that at least one of the valve devices 36*a-e* has opened, and that the valve device 36*a* can open only once, the valve device 36*b* can open only twice, the valve device 36*c* can open only three times, the valve device 36*d* can open only four times and the valve device 36*e* can open only five times. Therefore, pressure in the interior of the tubular string 20 can be manipulated in such a way that the leaking seals 14*a-e* or 16*a-e* can be determined.

Picking up from the point in the procedure at which a loss of pressure and/or fluid in the tubular string 20 initially indicates that a leak is present, it is known that at least one of the valve devices 36*a-e* has opened. Pressure in the interior of the tubular string 20 can be permitted to decrease (to close any open valve devices), and then can be increased for a second pressure test. If, upon this pressure increase no leaking (loss of pressure and/or fluid from the interior of the tubular string 20) is detected, then it can be determined that the previous leaking was that of either of the seals 14*a* or 16*a*, because the valve device 36*a* is locked closed (after being opened only once) and none of the other valve devices 36*b-e* has opened.

If leaking is detected during the second pressure test, then it must be via fluid communication through one of the open valve devices 36*b-e*. Pressure in the interior of the tubular string 20 can be permitted to decrease (to close any open valve devices), and then can be increased for a third pressure test. If, upon this pressure increase no leaking (loss of pressure and/or fluid from the interior of the tubular string 20) is detected, then it can be determined that the previous leaking was that of either of the seals 14*b* or 16*b*, because the valve device 36*b* is locked closed (after being opened twice) and none of the other valve devices 36*a* or *c-e* has opened.

It will be appreciated that, in this manner, a number of pressure tests may be performed to thereby determine which of the valve devices 36*a-e* is opening due to leakage past its associated seals 14*a-e* or 16*a-e*. In this example, a lack of leakage during the nth pressure test indicates that the n−1 valve device from the top has been opening. Of course, the valve devices 36*a-e* can be differently configured as desired to permit different procedures for determining which of the seals 14*a-e* or 16*a-e* is leaking.

Figure 17:
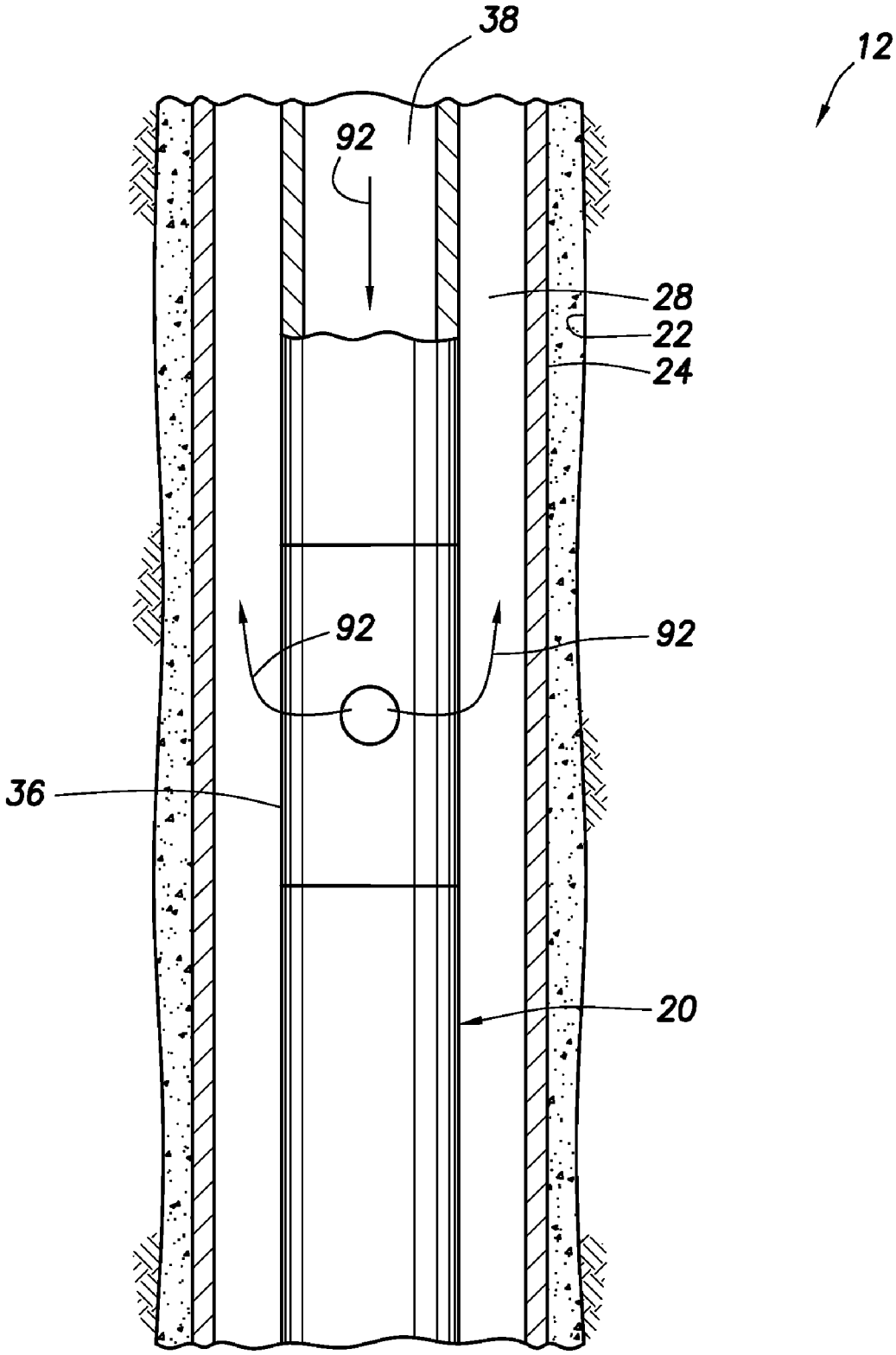
FIG. 17 is a schematic partially cross-sectional view of another method of using the valve device.

Referring additionally now to FIG. 17, another configuration of the well system 12 is representatively illustrated in which the valve device 36 is not used in a gravel packing operation but is instead used to permit selective fluid communication between the passage 38 and the annulus 28, for example, in cementing, circulating, producing, stimulating, acidizing, fracturing, injecting, or other types of operations. As depicted in FIG. 17, fluid 92 is flowed between the interior and the exterior of the tubular string 20 via the open flowpath 58 in the valve device 36.

For example, in a cementing operation, the valve device 36 may be opened after cement has been flowed out of a lower end of the tubular string 20 and upward into the annulus 28. A dart (not shown) may land in the lower end of the tubular string 20 and an increase in pressure in the interior of the tubular string can cause the valve device 36 to open, thereby allowing the fluid 92 to circulate out any excess cement in the annulus 28 above the valve device.

Pressure in the interior of the tubular string 20 can then be decreased to allow the valve device 36 to close. Preferably, the valve device 36 would be locked closed by the lock assembly 74, so that subsequent opening of the valve device is prevented.

It may now be fully appreciated that many advancements in the art of selectively permitting and preventing fluid communication between the interior and exterior of a tubular string are provided by the above disclosure. In particular, these advancements include the valve device 36 in its various configurations described above, which permits testing of annular seals 14, 16 in ways not previously economical, convenient or practical.

The above disclosure provides a valve device 36 which includes an openable and closable flowpath 58 for selectively permitting and preventing flow between an interior and an exterior of the valve device 36, and a lock assembly 74 which prevents the flowpath 58 from being cycled from closed to open greater than a predetermined number of times.

The flowpath 58 may be locked closed in response to a) the flowpath 58 having been cycled from closed to open the predetermined number of times, and then b) the flowpath 58 being closed.

The predetermined number of times (greater than which the flowpath 58 is prevented from being cycled from closed to open) may be greater than one. Thus, the flowpath 58 may be opened more than once.

The flowpath 58 may open in response to increased pressure in the interior of the valve device 36, and the flowpath 58 may close in response to decreased pressure in the interior of the valve device 36.

The flowpath 58 may be opened at least one time after having been closed.

The flowpath 58 may open in response to a predetermined pressure differential being applied between the interior and exterior of the valve device 36. The flowpath 58 may close in response to release of the predetermined pressure differential.

Also provided by the above disclosure is a method of testing at least one annular seal 14, 16 in an annulus 28 formed between a tubular string 20 and a wellbore wall 26. The method includes the steps of: sealingly engaging the annular seal 14, 16 to thereby prevent flow through the annulus 28 across the annular seal 14, 16; and applying a pressure differential across the annular seal 14, 16 to thereby test the annular seal, with the pressure differential being applied via a valve device 36 interconnected in the tubular string 20.

The pressure differential applying step may also include transmitting pressure between an interior flow passage 38 of the tubular string 20 and the annulus 28 via the valve device 36 without permitting fluid communication between the annulus and the flow passage.

The method may also include the step of, after the pressure differential applying step, closing the valve device 36 interconnected in the tubular string, thereby preventing fluid communication through the valve device 36 between the annulus 28 and an interior flow passage 38 of the tubular string 20. The closing step is performed without manipulating the tubular string 20 and without intervening into the tubular string 20.

The closing step may include preventing flow from the annulus 28 into the flow passage 38. The closing step may include preventing flow from the flow passage 38 into the annulus 28.

The pressure differential applying step may include providing fluid communication between the annulus 28 and the flow passage 38 via the valve device 36.

The fluid communication providing step may include opening the valve device 36 by applying increased pressure to the flow passage 38. The fluid communication preventing step may include decreasing pressure in the flow passage 38 after the step of applying increased pressure to the flow passage 38.

The above disclosure also provides a test system 10 for a well having an annulus 28 formed between a tubular string 20 and a wall 26 of a wellbore 22. The system 10 includes multiple sets of annular seals 14*a-e*, 16*a-e* for sealing the annulus 28 at longitudinally spaced apart locations, with each of the sets including at least two annular seals. The system 10 also includes multiple valve devices 36*a-e* which are openable and closable in response to variation of pressure in an interior flow passage 38 of the tubular string 20. Each of the valve devices 36*a-e* thereby selectively permits and prevents fluid communication between the interior flow passage 38 and the annulus 28 longitudinally between the annular seals of a respective one of the sets of annular seals 14*a-e*, 16*a-e*.

Each successive one of the valve devices 36*a-e* may be configured to lock closed in response to a correspondingly increased number of pressure manipulations in the flow passage 38.

Each of the valve devices 36*a-e* may open only if a corresponding at least one of the annular seals 14*a-e*, 16*a-e* leaks. The valve devices 36*a-e* may be closable in response to pressure variation in the interior flow passage 38 after the valve devices have been opened.

Also provided by the above disclosure is an annular seal assembly 18 which includes at least two annular seals 14, 16 and a valve device 36. The valve device 36 comprises an openable and closable flowpath 58 for selectively permitting and preventing flow between an interior of the seal assembly 18 and an exterior of the seal assembly 18 longitudinally between the annular seals 14, 16, and a lock assembly 74 which prevents the flowpath 58 from being cycled from closed to open greater than a predetermined number of times. The flowpath 58 is cyclable from closed to open at least one time.

The flowpath 58 may be closable without manipulating the annular seal assembly 18 and without intervening into the annular seal assembly. The flowpath 58 may be openable by applying increased pressure to the interior of the seal assembly 18, and the flowpath may be closable by decreasing pressure in the interior of the seal assembly after applying increased pressure to the interior of the seal assembly.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A valve device, comprising:

an openable and closable flowpath which respectively permits and prevents pressure communication between an interior and an exterior of the valve device, wherein the flowpath opens in response to increased pressure in the interior of the valve device, and wherein the flowpath closes in response to decreased pressure in the interior of the valve device; and a lock assembly which prevents the flowpath from being cycled from closed to open greater than a predetermined number of times.

2. The valve device of claim 1, wherein the flowpath is locked closed in response to a) the flowpath having been cycled from closed to open the predetermined number of times, and then b) the flowpath being closed.

3. The valve device of claim 1, wherein the predetermined number of times is greater than one.

4. The valve device of claim 1, wherein the flowpath is openable at least one time after having been closed.

5. The valve device of claim 1, wherein the flowpath opens in response to a predetermined pressure differential being applied between the interior and exterior of the valve device.

6. The valve device of claim 5, wherein the flowpath closes in response to release of the predetermined pressure differential.

7. A method of testing at least one annular seal in an annulus formed between a tubular string and a wellbore wall, the method comprising the steps of:

sealingly engaging the annular seal, thereby preventing flow through the annulus across the annular seal; and applying a pressure differential across the annular seal, thereby testing the annular seal, the pressure differential being applied via a valve device interconnected in the tubular string, wherein the pressure differential applying step further comprises transmitting pressure between an interior flow passage of the tubular string and the annulus via the valve device without permitting fluid communication between the annulus and the flow passage.

8. The method of claim 7, further comprising the step of, after the pressure differential applying step, closing the valve device interconnected in the tubular string, thereby preventing fluid communication through the valve device between the annulus and an interior flow passage of the tubular string, the closing step being performed without manipulating the tubular string and without intervening into the tubular string.

9. The method of claim 8, wherein the closing step further comprises preventing flow from the annulus into the flow passage.

10. The method of claim 8, wherein the closing step further comprises preventing flow from the flow passage into the annulus.

11. The method of claim 8, wherein the pressure differential applying step further comprises providing fluid communication between the annulus and the flow passage via the valve device.

12. The method of claim 11, wherein the fluid communication providing step further comprises opening the valve device by applying increased pressure to the flow passage.

13. The method of claim 12, wherein the fluid communication preventing step further comprises decreasing pressure in the flow passage after the step of applying increased pressure to the flow passage.

14. A test system for a well having an annulus formed between a tubular string and a wall of a wellbore, the system comprising:

multiple sets of annular seals which seal off the annulus at longitudinally spaced apart locations, each of the sets including at least two annular seals; and multiple valve devices which are openable and closable in response to variation of pressure in an interior flow passage of the tubular string, each of the valve devices thereby respectively permitting and preventing pressure communication between the interior flow passage and the annulus longitudinally between the annular seals of a respective one of the sets of annular seals, wherein each of the valve devices provides fluid communication between the interior flow passage and the annulus longitudinally between the annular seals only if a corresponding at least one of the annular seals leaks.

15. The system of claim 14, wherein each successive one of the valve devices is configured to lock closed in response to a correspondingly increased number of pressure manipulations in the flow passage.

16. The system of claim 14, wherein the valve devices are closable in response to pressure variation in the interior flow passage after the valve devices have been opened.

17. An annular seal assembly, comprising:

at least two annular seals;

a valve device including an openable and closable flowpath which respectively permits and prevents pressure communication between an interior of the seal assembly and an exterior of the seal assembly longitudinally between the annular seals, wherein the flowpath is openable by applying increased pressure to the interior of the seal assembly, and wherein the flowpath is closable by decreasing pressure in the interior of the seal assembly after applying increased pressure to the interior of the seal assembly; and a lock assembly which prevents the valve device from being cycled from closed to open greater than a predetermined number of times, the valve device being cyclable from closed to open at least one time.

18. The annular seal assembly of claim 17, wherein the flowpath is closable without manipulating the annular seal assembly and without intervening into the annular seal assembly.

* * * * *